United States Patent [19]

Darlington

[11] Patent Number: 4,675,076

[45] Date of Patent: Jun. 23, 1987

[54] METHOD FOR BRIGHTENING PULP

[75] Inventor: William B. Darlington, Wadsworth, Ohio

[73] Assignee: PPG Industries, Inc., Pittsburgh, Pa.

[21] Appl. No.: 913,893

[22] Filed: Oct. 1, 1986

[51] Int. Cl.[4] ..... D21C 3/20; D21C 3/00

[52] U.S. Cl. ..... 162/72; 162/78

[58] Field of Search ..... 162/72, 78

[56] References Cited

U.S. PATENT DOCUMENTS

| | | | |
|---|---|---|---|
| 3,384,534 | 5/1968 | Kindron et al. | 162/71 |
| 3,481,828 | 12/1969 | Turner et al. | 162/72 |
| 3,507,743 | 4/1970 | Cartsunis et al. | 162/72 |
| 4,244,780 | 1/1981 | Rende et al. | 162/72 |

FOREIGN PATENT DOCUMENTS

| | | |
|---|---|---|
| 0187477 | 7/1986 | European Pat. Off. . |
| 1404315 | 8/1975 | United Kingdom . |

OTHER PUBLICATIONS

*Chemical Abstracts,* 95:64045n.

*Chemical Abstracts,* 96:124823x.

*Primary Examiner*—Peter Chin

*Assistant Examiner*—Thi Dang

*Attorney, Agent, or Firm*—Bruce H. Cottrell

[57] ABSTRACT

A method is disclosed for achieving additional bleaching of a wood pulp following a peroxide bleaching of the pulp, the method involving added thiourea to the slurry at a pH of 4 to 7 in the presence of residual peroxide and thereafter maintaining the slurry at a pH of 8 to 11.

17 Claims, No Drawings

METHOD FOR BRIGHTENING PULP

This invention relates to a process for enhanced bleaching of wood pulp by the addition of thiourea to a wood pulp slurry subsequent to a peroxide bleaching step.

BACKGROUND OF THE INVENTION

Various processes are employed in the pulp and paper industry to bleach wood pulp. Among these processes are peroxide bleaching processes and thiourea dioxide bleaching processes.

Peroxide is an effective lignin-preserving bleaching agent. It improves the brightness of groundwood, i.e. mechanical, chemimechanical or other highly lignified pulps, without significant shrinkage in yield. Peroxide may be provided by conventional inorganic peroxides such as hydrogen peroxide or sodium peroxide, or by organic peroxides such as benzoyl peroxide, di(tertiary-butyl) peroxide or peracetic acid. Peroxide bleaching solutions, usually with hydrogen peroxide, are generally adjusted to a pH of about 9 to 11 by addition of sodium silicate, and optionally, sodium hydroxide, before addition to a pulp slurry. Such solutions may also contain a small amount of a soluble magnesium salt, e.g., magnesium sulfate, as a stabilizing agent and an organic chelating agent such as diethylenetriamine pentaacetic acid or alkali metal salts thereof. In peroxide bleaching, pulp consistency in the aqueous slurry is generally between about 1 and about 35 percent by weight. The process is usually conducted at temperatures between about 30° C. and 90° C., and retention times are generally from about 1 to 5 hours. The strength of the peroxide bleaching solution expressed in terms of its peroxide content is usually in the range of about one to three percent peroxide by weight. Higher strengths may be used but are economically unattractive. Following peroxide bleaching, residual peroxide generally remains in the pulp slurry. Standard practice in the bleaching industry has been to neutralize residual peroxide with either sulfur dioxide or sodium bisulfite.

The aforesaid neutralization process requires use of a reagent such as sulfur dioxide to neutralize residual peroxide in the pulp slurry. Such a process is wasteful of both the excess peroxide and the neutralizing agent. It has now been found that if thiourea is added to a wood pulp slurry containing residual peroxide following a peroxide bleaching step, additional bleaching of the wood pulp can be achieved beyond that provided by peroxide bleaching.

SUMMARY OF THE INVENTION

In accordance with the present invention, thiourea is added to a residual peroxide-containing wood pulp slurry following peroxide bleaching of the wood pulp. The peroxide-containing wood pulp slurry to which the thiourea is added has a pH of from about 4 to about 7. Following addition of the thiourea, the pH of the slurry is raised to from about 8 to about 11 and the slurry maintained within a range from about 8 to about 11 for a time sufficient to achieve additional bleaching of the wood pulp. Thiourea is added to the slurry in amounts of from about 0.05 to 3.0 moles thiourea per mole of residual peroxide, more preferably from about 0.25 to 1.0 moles thiourea per mole of residual peroxide slurry and most preferably, in amounts of thiourea from about 0.25 mole up to 0.50 mole thiourea per mole residual peroxide in the slurry. Optionally wood pulp treated in accordance with the process of this invention may be bleached further with additional peroxide.

DETAILED DESCRIPTION OF THE INVENTION

The present invention is directed to a process for increasing the brightness of mechanical and chemimechanical wood pulps. In such wood pulps, separation of wood material into fibers is achieved primarily through mechanical attrition of the wood. For example, in mechanical pulps, logs or other large pieces of wood are ground on a grinding stone or wood chips are mechanically subdivided in a disc or similar type of refiner. Chemimechanical methods involve softening of wood with aqueous softening agents such as sulfites, bisulfites and the like prior to mechanical subdivision of the wood into fibers. Lack of strong chemical attack on the wood material leaves most of the non-cellulosic constituents in the fibers. Mechanical or chemimechanical pulps produced by either of these essentially mechanical means are also referred to as low cellulose or high yield wood pulps. Low cellulose or high yield wood pulps are particularly desirable because of low cost and generally satisfactory physical properties. The process of the present invention generally follows a conventional peroxide bleaching step in which residual peroxide remains in the pulp slurry.

In peroxide bleaching, a peroxide compound, e.g., generally an inorganic peroxide such as hydrogen peroxide or sodium peroxide, is added to a mechanical or chemimechanical pulp slurry in amounts of about 0.1 to 20 percent by weight, more preferably from about 0.5 to about 10 percent by weight, and most preferably for economic reasons from about 1 to about 3 percent by weight, basis total weight of oven dried (O.D.) pulp. Peroxide solutions are usually buffered and stabilized before addition to the pulp to avoid catalytic decomposition of the peroxide by metallic ions such as manganese, copper or iron. For example, sodium silicate is a common buffer which is also capable of acting as a stabilizer. A typical peroxide bleaching solution is prepared by adding sodium silicate to a dilute solution of magnesium sulfate followed by addition of sodium hydroxide and hydrogen peroxide. Other stabilizers or chelating agents, such as diethylenetriamine pentaacetic acid or ethylenediamine tetraacetic acid, can be used with the peroxide solution. The consistency of the pulp in the aqueous slurry during peroxide bleaching is generally from about 1 to about 35 percent by weight, more preferably from about 5 to 25 weight percent and most preferably in present commercial operations from about 5 to about 15 weight percent, basis the total slurry weight. In commercial operations, the preferred level is the level at which a vacuum-drawn thickener can dewater the pulp slurry.

In the present invention, thiourea is added to a pulp slurry containing residual peroxide following peroxide bleaching. Residual peroxide of about 20 to 25 percent of the usual 1 to 3 weight percent peroxide charge, basis total weight of oven dried pulp, generally remains after a peroxide bleaching step. Thiourea is added to the residual peroxide-containing pulp slurry in amounts from about 0.05 to 3.0 moles thiourea per mole of residual peroxide, more preferably, from about 0.25 to 1.0 moles thiourea per mole of residual peroxide. Before the addition of the thiourea, the pH of the slurry should be adjusted, i.e., lowered, to from about 4 to about 7, more preferably from about 5 to about 6. Generally,. any temperature above the freezing point of the pulp slurry is acceptable during thiourea addition. Preferably, the temperature of the pulp slurry is maintained within a range of from about 5° C. to about 30° C. as additional bleaching achieved by the process of this invention may be reduced when thiourea addition is conducted at higher temperatures. Subsequently, the pH of the slurry is raised to from about 8 to about 11 and the pH is maintained within this range for a time sufficient to achieve further bleaching of the wood pulp.

The amount of bleaching is determined by forming handsheets from a treated wood pulp slurry and then measuring the brightness of such handsheets using a photometer in accordance with TAPPI method T 452 om-83. The additional bleaching obtainable by the present process may typically provide an increased brightness of from about 3 to 7 brightness points beyond that obtained from peroxide bleaching alone.

After addition of thiourea, bleaching of the wood pulp is maximized by maintaining the pulp slurry, at least initially, at an alkaline pH of from about 8 to 11, more preferably from about 8.5 to 10, and at temperatures above 50° C., more preferably from about 60° C. to 90° C. For example, the pulp slurry pH is initially adjusted to from about 8.5 to about 10, e.g., by addition of sodium hydroxide, and bleaching is then conducted with heating at from about 60° C. to 90° C. The enhanced bleaching is carried out for generally from about 0.25 to about 4 hours, usually from about 1 to 2 hours. Gradually, the pH of the pulp slurry will decline during this period. For best brightness results on mechanical or chemimechanical pulp, it is preferable to initially carry out the bleaching for from about 0.5 to 2 hours at a pH of from about 8.5 to about 10, to follow with reduction of the pH in the pulp slurry to from about 5 to about 6, e.g., by addition of a mineral acid, and then to continue the bleaching for from about 0.25 hour to 3 hours, usually 0.25 to 1 hour.

In one embodiment of this invention, the pulp slurry is analyzed to measure the residual peroxide concentration following the peroxide bleaching step. Then, thiourea addition can be regulated to provide the desired molar ratio of thiourea per mole of residual peroxide. While not wishing to be bound to any particular theory, it is believed that the thiourea reacts with the residual peroxide to form thiourea dioxide, a known bleaching agent. The residual peroxide and the thiourea may react according to the balanced equation: $(NH_2)_2CS+2H_2O_2 \rightarrow (NH_2)_2CSO_2+2H_2O$. Thus, thiourea dioxide generated in situ would in accordance with such equation be present in amounts proportional to the amount of residual peroxide in the pulp slurry. Preferably, thiourea is added in substoichiometric amounts for the proposed reaction with peroxide so that essentially all the thiourea is theoretically converted to thiourea dioxide. Substoichiometric amounts are amounts less than 0.50 mole of thiourea per mole of residual peroxide. Preferably, substoichiometric amounts of from about 0.25 mole up to 0.50 mole of thiourea per mole of residual peroxide are used. Optionally, the thiourea can be added in excess. U.S. Pat. No. 3,507,443 discloses that the incorporation of a small amount of thiourea during the bleaching of wood pulp with a reductive bleaching agent such as thiourea dioxide can minimize brightness reversion of the pulp. Addition of excess thiourea, in the practice of this invention, may also minimize brightness reversion of the pulp.

The pulp consistency in the slurry during thiourea addition and subsequent bleaching can range from about 1 to about 20 weight percent, more preferably from about 1 to about 10 weight percent and most preferably from about 2 to about 5 weight percent, basis total weight of slurry.

In a preferred embodiment of the bleaching process of this invention, the pulp is slurried at the desired concentration, e.g., at about 10 weight percent wood content, basis total weight of slurry and peroxide bleaching solution is first added to the slurry. Such a peroxide bleaching solution may contain buffers such as sodium silicate, stabilizers such as magnesium ions from magnesium sulfate, metal chelating agents such as diethylenetriamine pentaacetic acid, and an alkali material such as sodium hydroxide to provide the desired alkalinity. The temperature of the slurry is maintained at the desired level, generally from about 30° C. to 90° C. by, e.g., external heating means or passing steam through the pulp slurry. After the peroxide bleaching step is completed, a time period generally requiring about 1 to 4 hours, the residual peroxide content of the slurry is determined by analysis or knowledge of the system and the pH lowered to from about 5 to about 6. The pulp slurry is than cooled by appropriate means, generally to less than 30° C. and thiourea is added to the pulp slurry in an amount of from about 0.25 to 1.0 moles thiourea per mole of residual peroxide. Shortly after addition of the thiourea, generally between about 0.1 and 1 hour, more preferably from about 0.25 to 0.5 hour, the pH is raised to from about 9 to 10, the temperature of the slurry raised to about 60° C. to 90° C. and the additional bleaching conducted. After about 0.25 to 1 hour, the pH of the slurry is lowered to from about 5 to about 6 and bleaching is continued from about 0.25 to about 2 hours. The pulp slurry is thereafter formed into paper in accordance with conventional practice.

Optionally, after the present bleaching process, the wood pulp slurry is again subjected to a peroxide bleaching step to attain yet additional pulp brightness. Such steps as the peroxide bleaching and the present process involving thiourea addition may be repeated as long as economic results are obtained in terms of cost versus brightness gain.

The present invention is more particularly described in the following examples which are intended as illustrative only, since numerous modifications and variations will be apparent to those skilled in the art.

EXAMPLE I

An aqueous slurry of a groundwood pulp having a total slurry weight of 400 grams(g) (4.4 percent by weight oven-dried pulp, wood content 85 percent spruce/fir and 15 percent aspen) was placed in a reaction vessel under a purge of nitrogen. The following reagents were added sequentially in amounts to bring the concentrations to the indicated levels: sodium hydroxide, 2 weight percent; sodium silicate, 4 weight percent; magnesium sulfate, 0.05 weight percent; and diethylenetriaminepentaacetic acid, 0.2 weight percent; all on the basis of the total weight of oven-dried pulp. At this point the pH of the pulp slurry was 10.7 and the temperature was 25° C. The slurry was heated with stirring to 55° C. for one hour whereafter the pH was 9.8. The pH was adjusted with sodium hydroxide to 10.5 and hydrogen peroxide equivalent to one weight percent of the total weight of oven-dried pulp was added. The reaction vessel was continually purged with nitrogen. After a short time, another one weight percent of hydrogen peroxide was added. After a total time of about 3.5 hours of bleaching, the pulp slurry was removed from the vessel. A 6 milliliter (ml) sample was analyzed for $H_2O_2$ using a standard iodometric determination as described in *Hydrogen Peroxide*, W. C. Schumb et. al., Monograph 128, American Chemical Society, Reinhold, New York, N.Y., 1955, at p 557. Analysis indicated 8.36 milliequivalents of peroxide present in total pulp slurry.

Two hundred milliliters of the slurry were diluted to two liters, acidified with sulfuric acid to a pH of 5.5 and used to prepare two handsheets by TAPPI method T 218 om-83. The brightness of these handsheets was measured according to TAPPI method T 452 om-83 "Brightness of Pulp Paper and Paperboard" using an ELREPHO photometer (from Carl Zeiss, Inc.) calibrated to read in percent ISO. The brightness of these handsheets was measured as 70.6 and 70.3% ISO. Handsheets prepared in similar fashion from the unbleached groundwood had a brightness of from about 61 to 64% ISO.

The remainder of the pulp slurry, about 180 ml, was reinserted into a reaction vessel. This portion of the slurry had about 3.9 milliequivalents of peroxide. The pH was lowered to 5, the temperature lowered to 33° C., and then 0.2 grams of thiourea was added with stirring under nitrogen. The temperature of the pulp slurry was then gradually raised over twenty minutes to between 80° C. and 85° C., the pH adjusted to between 8 and 9.5 and the pulp slurry stirred. After about 0.5 hour, the pH of the pulp slurry was reduced to 5.6 by addition of sulfuric acid. After about 10 minutes, the bleaching was stopped, the pulp was diluted to 2 liters and two handsheets were made by the procedure previously described. The brightness of these handsheets was measured as 71.6 and 71.4% ISO.

EXAMPLE II

An aqueous slurry of a groundwood pulp (400g) containing 0.014 weight percent sodium tripolyphosphate (3.5 percent by weight oven dried pulp, wood content 85 percent spruce/fir and 15 percent aspen) was placed in a reaction vessel under a purge of nitrogen. Diethylene triaminepentaacetic acid was added at a concentration of 0.003 percent by weight, basis total slurry weight. The pH of the solution was adjusted to 9.5 and the pulp slurry was heated with stirring. After heating for 45 minutes, a solution of the following reagents was added to bring the concentrations to the following levels, basis total slurry weight: hydrogen peroxide, 0.090 weight percent; sodium hydroxide, 0.14 weight percent; magnesium sulfate, 0.004 weight percent; and sodium silicate 0.21 weight percent. The peroxide bleaching was carried out for nearly 3.5 hours. Then, the pH was lowered to 5.8 by addition of 5 percent by weight sulfuric acid. The total slurry volume was 460 ml. Analysis of the pulp slurry by iodometric determination showed total hydrogen peroxide of 9.5 milliequivalents or 0.035 weight percent hydrogen peroxide, basis the slurry weight, remained. The pulp was divided into two portions. One was diluted to 2 liters and two handsheets were prepared to determine the bleaching results from the peroxide. The brightness of these handsheets was determined to have an average value of 70.3% ISO. The other portion of the slurry was recharged to the reaction vessel and kept under a nitrogen purge. After the pH was lowered to 5.4, thiourea (0.76 g) was added to the reaction vessel cooled at a temperature of 18° C. After 40 minutes, the reaction vessel pulp slurry was gradually heated about an hour to about 70° C. and the pH was gradually raised to 9.5 with a one percent sodium hydroxide solution using a pH controller. After nearly two hours, the pH was lowered to between 5.5 and 6.7 with the addition of one percent be weight sulfuric acid and the bleaching continued for another 1.25 hours. The pulp slurry was then diluted and two handsheets were prepared as before. The brightness of these handsheets was measured to be an average value of 76.4% ISO. Handsheets prepared from the unbleached groundwood of this example had a brightness of about 63% ISO.

EXAMPLE III

An aqueous slurry of a groundwood pulp (400 g) containing 0.4% sodium tripolyphosphate and 0.2% diethylenetriamine pentaacetic acid, basis pulp weight, (3.7 percent by weight oven dried pulp, wood content 85% spruce/fir and 15% aspen) was placed in a reaction vessel under a purge of nitrogen gas. As the pulp slurry was stirred, the temperature was gradually raised to 64° C. and the pH raised to 10.6 with 1 percent sodium hydroxide. Then, a 0.7% hydrogen peroxide solution, also including sodium hydroxide, magnesium sulfate and sodium silicate, was added to give a concentration in the slurry of 0.08% hydrogen peroxide by weight, basis total slurry weight. The pulp slurry then contained 0.14 weight percent sodium silicate, basis total slurry weight.

The pulp slurry was stirred and heated for 65 minutes while maintaining the pH at 10.3. Then, an amount of the hydrogen peroxide solution, half that of the earlier peroxide addition, was added to the reaction vessel. With continued stirring, the pH was maintained at from 10.3 to 10.6 and the temperature at from 61° C. to 64° C. for 235 minutes. A third addition of hydrogen peroxide solution, equivalent in size to the first peroxide addition was added.

While the slurry was stirred, the pH was maintained at from 10.6 to 10.7 and the temperature maintained at from 61° C. to 64° C. A final hydrogen peroxide solution addition equivalent to the second addition was added. The total pulp slurry volume was 425 milliliters (ml) and analysis for hydrogen peroxide indicated 0.02 percent by weight, basis total slurry weight.

A 225 ml portion of the pulp slurry was formed into two handsheets having a brightness of 66.9% ISO. The other 200 ml of the pulp slurry was placed in a reaction vessel and cooled to 18° C. while stirred. The pH was adjusted to 5.5 with one percent sulfuric acid and additional hydrogen peroxide added to give a concentration of 0.035 weight percent hydrogen peroxide in the slurry, basis total slurry weight. The additional hydrogen peroxide was added at this time to assure the presence of residual peroxide. Then, thiourea (0.61 g) was added to the slurry. The slurry was stirred for 66 minutes at 18° C. and a pH of from 5.6 to 5.7. The pH was then increased to 9.4, the temperature raised to 81° C. and the slurry was stirred for 126 minutes. The pH was then reduced to 5.6 with 1 percent sulfuric acid and the slurry was stirred for 1 hour at 30° C. The slurry was used to prepare two handsheets as before and the brightness of these handsheets was measured at an average value 72.4% ISO. Handsheets prepared from the unbleached groundwood of this example had a brightness of about 63% ISO.

The above examples have demonstrated that the addition of thiourea to a pulp slurry containing residual peroxide following a peroxide bleaching of a groundwood pulp can provide additional bleaching of the groundwood pulp. Example II shows that 6 additional brightness points may be obtained by the process of the present invention over the brightness gain provided by peroxide bleaching alone.

Although the present invention has been described with reference to specific details, it is not intended that such details should be regarded as limitations upon the scope of the invention, except as and to the extent that they are included in the accompanying claims.

What is claimed is:

1. In a method of bleaching wood pulp by treating an aqueous wood pulp slurry with peroxide, thereby to produce an aqueous slurry of bleached wood pulp containing residual amounts of peroxide, the improvement comprising adding thiourea to a slurry of said peroxide-bleached wood pulp having a pH from about 4 to about 7 in amounts of from about 0.05 to 3.0 moles of thiourea per mole of residual peroxide and thereafter raising the pH of the slurry to a range from about 8 to about 11 and maintaining the pH of the slurry within said range for a time sufficient to achieve additional bleaching of the wood pulp.

2. The method of claim 1 wherein the slurry to which thiourea is added has a temperature of from about 5° C. to about 30° C.

3. The method of claim 1 wherein the slurry is maintained at temperatures in the range of from about 60° C. to 90° C. after the pH of the slurry is raised to from about 8 to about 11.

4. The method of claim 2 wherein the slurry is maintained at temperatures in the range of from about 60° C. to 90° C. after the pH of the slurry is raised to from about 8 to about 11.

5. The method of claim 1 wherein the aqueous wood pulp slurry includes from about 1 to about 20 percent by weight wood pulp.

6. The method of claim 2 wherein the aqueous wood pulp slurry includes from about 1 to about 20 percent by weight wood pulp.

7. The method of claim 1 wherein after additional bleaching is achieved following the thiourea addition, the wood pulp is further bleached by treatment with peroxide.

8. The method of claim 1 wherein following the peroxide treatment, the residual peroxide in the slurry is determined.

9. The method of claim 1 wherein the amount of thiourea added to the slurry is from 0.25 mole up to 0.50 mole thiourea per mole of residual peroxide in the slurry.

10. The method of claim 8 wherein the amount of thiourea added to the slurry is from about 0.25 up to 0.50 mole thiourea per mole of residual peroxide in the slurry.

11. The method of claim 1 wherein the slurry is maintained within the pH range from about 8 to about 11 for from about 0.5 to about 4 hours.

12. The method of claim 4 wherein the slurry is maintained within the pH range from about 8 to about 11 for from about 0.5 to about 4 hours.

13. The method of claim 1 wherein after maintaining the slurry within the pH range from about 8 to about 11, the pH is lowered to from about 5 to about 6 and then maintained within the lower pH range for about 0.25 to about 3 hours.

14. The method of claim 12 wherein after maintaining the slurry within the pH range from about 8 to about 11, the pH is lowered to from about 5 to about 6 and then maintained within the lower pH range for about 0.25 to about 3 hours.

15. The method of claim 1 wherein the peroxide is a hydrogen peroxide bleaching solution.

16. The method of claim 14 wherein the peroxide is a hydrogen peroxide bleaching solution.

17. In a method of bleaching wood pulp by treating an aqueous wood pulp slurry with hydrogen peroxide, thereby to produce an aqueous slurry of bleached wood pulp containing residual amounts of peroxide, the improvement comprising adding thiourea to a slurry of said peroxide-bleached wood pulp having a pH of from about 5 to about 6 and at temperatures within the range from about 5° C. to about 30° C. in amounts from about 0.25 up to 0.50 mole thiourea per mole of residual peroxide, thereafter raising the pH of the slurry to from about 8.5 to about 11 and the temperature to within the range from about 60° C. to about 90° C., maintaining the slurry at said raised pH and temperature for from about 0.25 to about 4 hours, thereafter lowering the pH of the slurry to from about 5 to about 6 and maintaining the slurry at said lowered pH for from about 0.25 to about 3 hours whereby to achieve additional bleaching of the wood pulp.

* * * * *